United States Patent [19]

Krogstad et al.

[11] 3,986,744

[45] Oct. 19, 1976

[54] REFUSE COLLECTING DEVICE

[76] Inventors: David Krogstad, 4824 N. Nagle Ave.; George A. Nigro, 4822 N. Nagle Ave., both of Chicago, Ill. 60630

[22] Filed: Aug. 27, 1975

[21] Appl. No.: 608,095

[52] U.S. Cl. ..... 294/55; 294/1 R; 119/1; 15/257.6

[51] Int. Cl.[2] ..... A01B 1/04

[58] Field of Search ..... 294/1 R, 19 R, 55; 248/99, 100, 101; 119/1 R; 43/11, 12; 15/257.1, 257.6, 257.9

[56] References Cited

UNITED STATES PATENTS

| | | | |
|---|---|---|---|
| 3,703,158 | 11/1972 | Lemier | 294/19 |
| 3,733,098 | 5/1973 | Tobias | 294/1 R |
| 3,768,851 | 10/1973 | Freeman | 294/1 R |
| 3,804,448 | 4/1975 | Schmieler | 294/1 R |
| 3,872,831 | 3/1975 | Cassidy | 119/1 |

*Primary Examiner*—James B. Marbert
*Attorney, Agent, or Firm*—Norman H. Gerlach

[57] ABSTRACT

A refuse collecting device which is designed particularly for dog or other animal waste or excrement embodies an open-ended, tubular, scoop-like body and has a flat bottom wall which constitutes a scoop proper and the forward edge of which is provided with comb-like teeth which enhances the pick-up action of the device when the latter is used on a lawn. A manipulating handle overlies the top wall of the tubular body and a combined closure plate and paddle member is hinged to the top wall of said body top wall and is spring-biased to a position wherein it extends across and fully closes the open front end of the body. A thumb piece which is secured to the combined closure plate and paddle member arches rearwardly over the handle and is accessible to the user's thumb whereby depression thereof causes said combined closure plate and paddle member to be swung forwardly and upwardly thus exposing the interior of the tubular body for excrement-scooping purposes. Release of the thumb piece allows said member to swing downwardly and rearwardly and by way of a paddle action to slide or sweep the scooped excrement rearwardly into the open front end of the tubular body. An ordinary paper or plastic bag which is telescopically received over the open rear end of the tubular body and is held in position by a rubber band or other suitable releasable attaching means constitutes a disposable receptacle which receives successive scoopings each time the handle, and consequently, the device as a whole, is upended.

7 Claims, 4 Drawing Figures

REFUSE COLLECTING DEVICE

The present invention relates generally to a refuse collecting device and has particular reference to a unitary device for removing and disposing of animal droppings or excrement, particularly those of dogs and cats, in such places as gardens and lawns and on or along sidewalks and other public places as well as indoors.

There are at the present time available a wide variety of refuse collecting devices which are designed for the same general use as that of the present invention, the majority of such devices functioning upon the scoop principle wherein forward motion of the device over the ground, floor, or other surface is intended to scoop up the waste material and deposit it within an associated container. However, as is the case with any scoop, unless a forward and rapid scooping action is applied to the device, efficient scooping is not attained and it is necessary to employ a separate pusher member or paddle either to hold the material stationary by reaction force while the scooping action is taking place or to impel the material positively and rearwardly into the device.

The refuse collecting device of the present invention likewise functions on the scoop principle and, briefly it is comprised of a relatively short, open-ended, tubular, scoop-like body. Such body embodies a flat bottom wall which constitutes a scoop proper or platform, and the forward or leading edge of such scoop proper or platform is provided with a transversely extending row of comb-like teeth which enhances the pick-up action when the device is used on a grassy surface such as a lawn or on a carpet or rug having a long nap. A flat combined closure plate and paddle member is hinged to the top wall of the tubular body and is spring-biased to a position wherein it extends vertically across the open front end of the body and closes the same. A carrying handle overlies the top wall of the tubular body while a thumb piece which is secured to the closure member arches upwardly and over the carrying handle where it is accessible to the thumb of the device operator or user who, upon depressing the thumb piece, may swing the combined closure plate and paddle member forwardly and upwardly to an open position where the open front end of the body is unobstructed for entrance of the scooped excrement or other waste material into the body. Release of the thumb piece allows said combined closure plate and paddle member to swing downwardly and rearwardly to its closed position across the open front end of the body and, in so swinging, such member acts as a paddle or broom to sweep the extrement or other waste material rearwardly and into the body. Thereafter, upon upending the handle so that the axis of the tubular body extends vertically, the contained excrement or other waste material falls by gravity from the body and is collected in a paper or plastic bag or like container which may be removably and telescopically received over the open rear end of the tubular body and held in place by a rubber band or other suitable releasable attaching means. By such an arrangement, it is unnecessary for the operator to carry with him a separate reaction member such as a broom, paddle, or the like.

The provision of a refuse collecting device such as has briefly been outlined above and possessing the stated advantages constitutes the principal object of the present invention.

The provision of a refuse collecting device which is extremely simple in its construction and, therefore, may be manufactured at a low cost; one which may be constructed largely from sheet metal stock by simple stamping and punching operations, thereby further contributing to economy of manufacture; one which, despite its sheet metal construction, is rugged and durable and will, therefore, withstand rough usage; one which is of lightweight construction; one which is attractive in its appearance and pleasing in its design; and one which otherwise is well-adapted to perform the services required of it, are further desirable features which have been borne in mind in the production and development of the present invention.

Other objects and advantages of the invention, not at this time set forth, will readily suggest themselves from a consideration of the following description.

The invention consists in the several novel features which are hereinafter set forth and are more particularly defined by the claims at the conclusion hereof.

In the accompanying two sheets of drawings forming a part of this specification or disclosure, one illustrative embodiment of the invention is shown.

Figure 3:
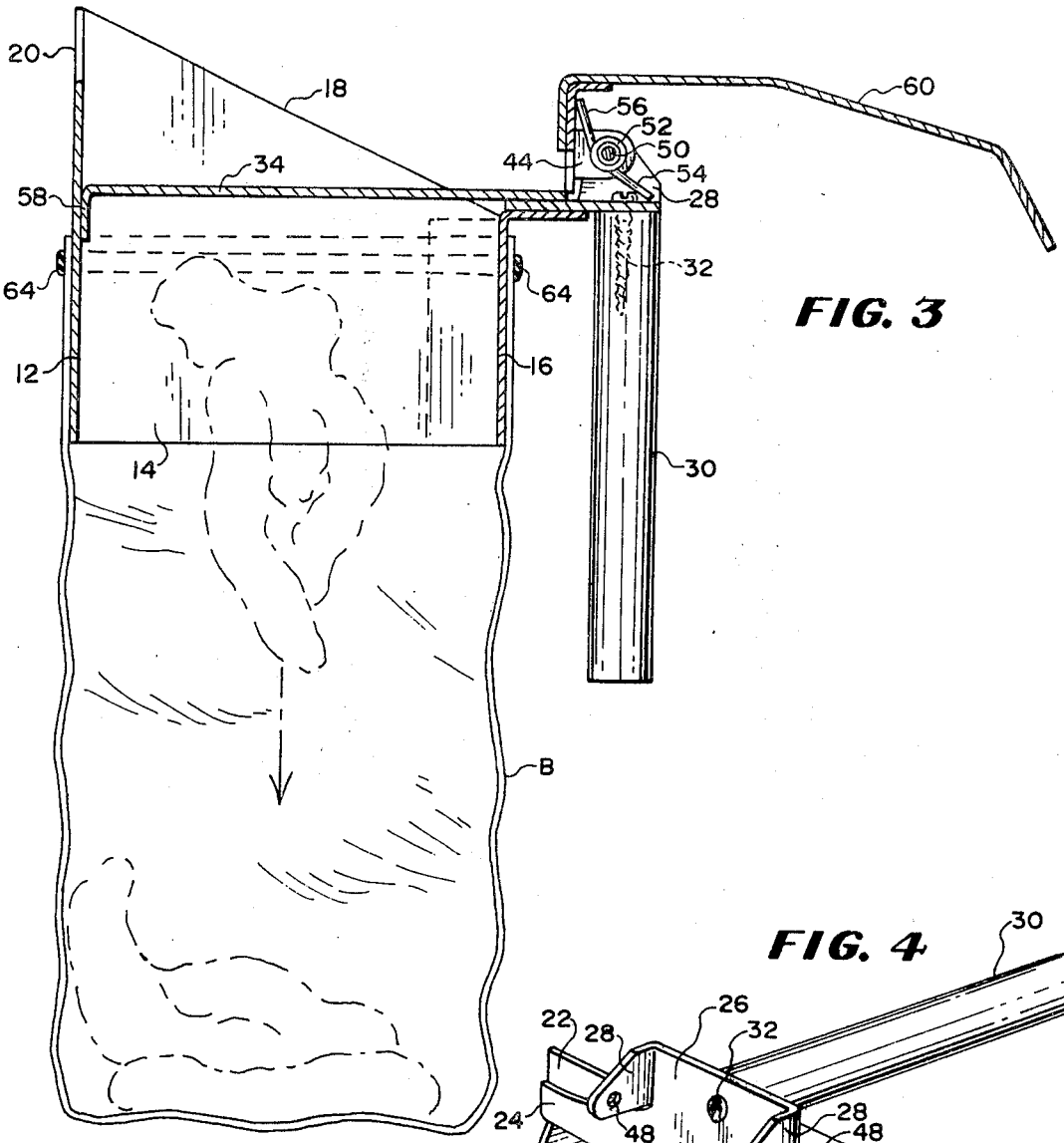
Figure 4:
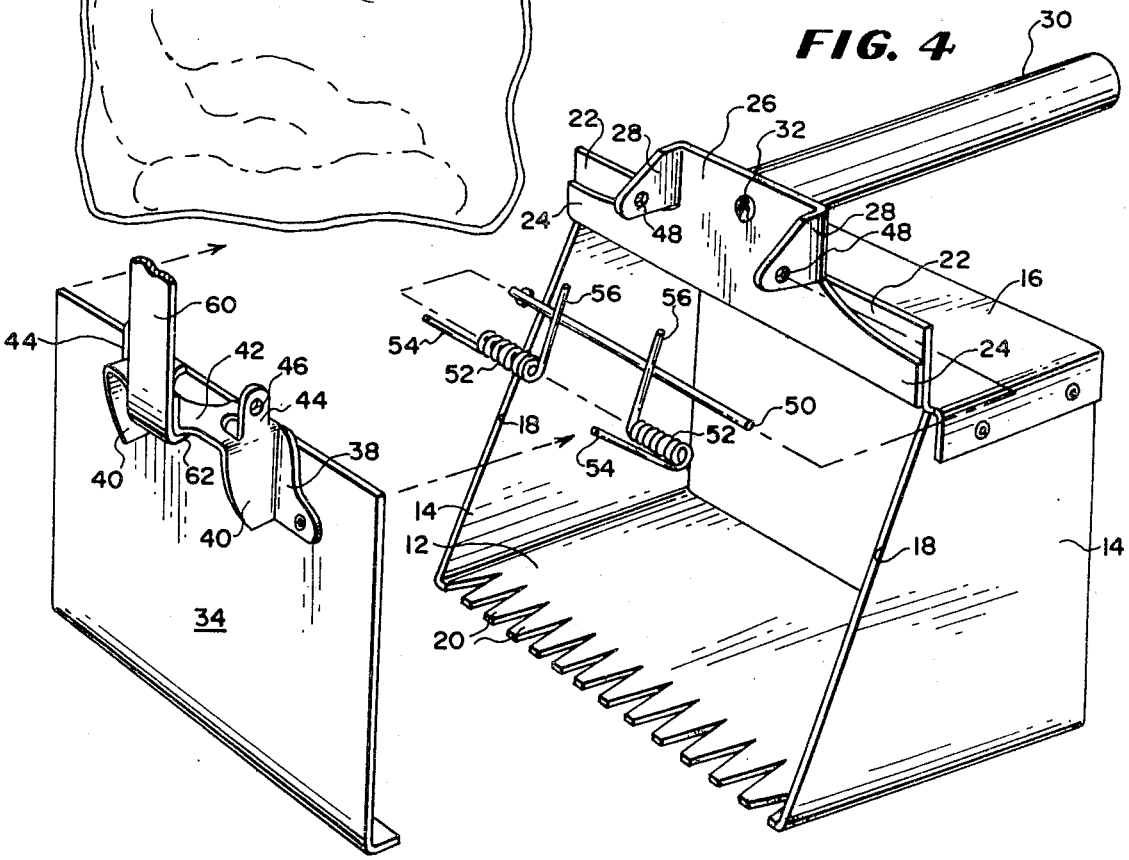

FIG. 3 is a sectional view taken centrally and longitudinally through the device, showing the latter in an upended position and illustrating the manner in which scooped excrement or other waste material is caused to drop down and enter a refuse bag or container which is associated with and removably attached to the device; and FIG. 4 is an exploded front right perspective view of the device, illustrating particularly the nature of the spring-biased hinge construction which is employed in connection with the invention.

Figure 1:
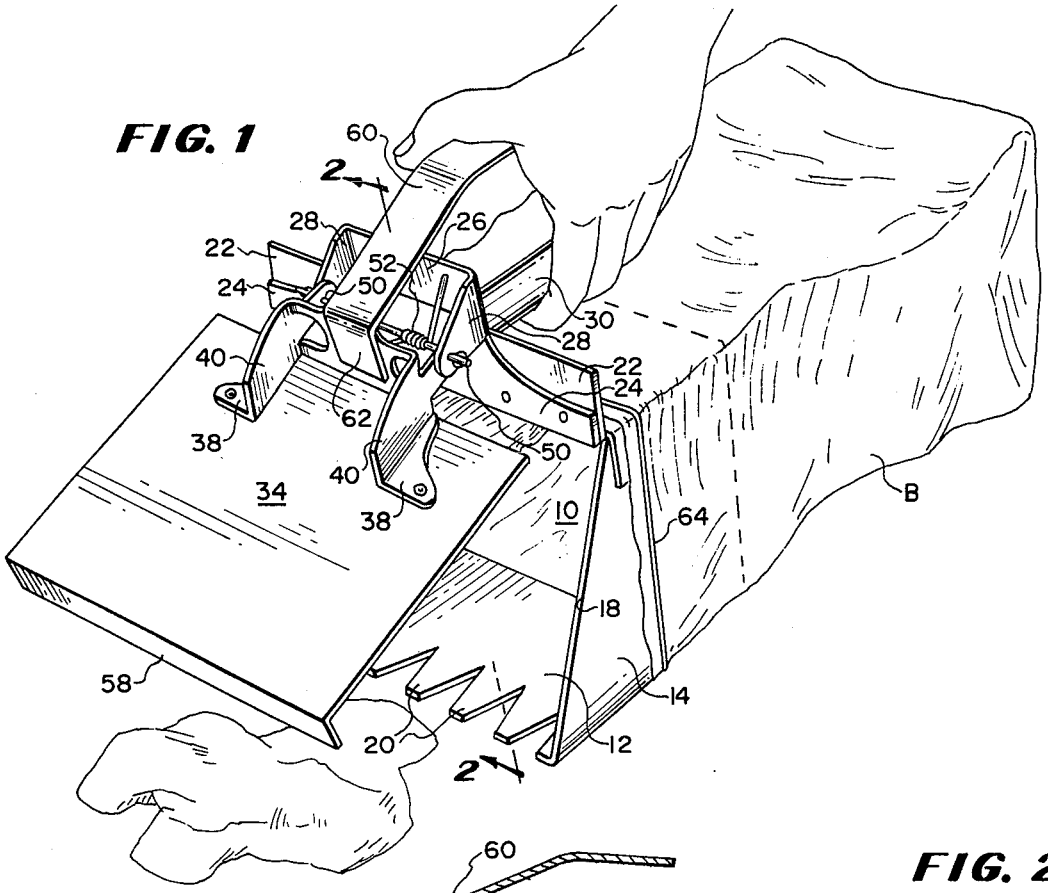
FIG. 1 is a front right perspective view of a refuse collecting device embodying the principles of the present invention and illustrating schematically the manner in which it is used.
Figure 2:
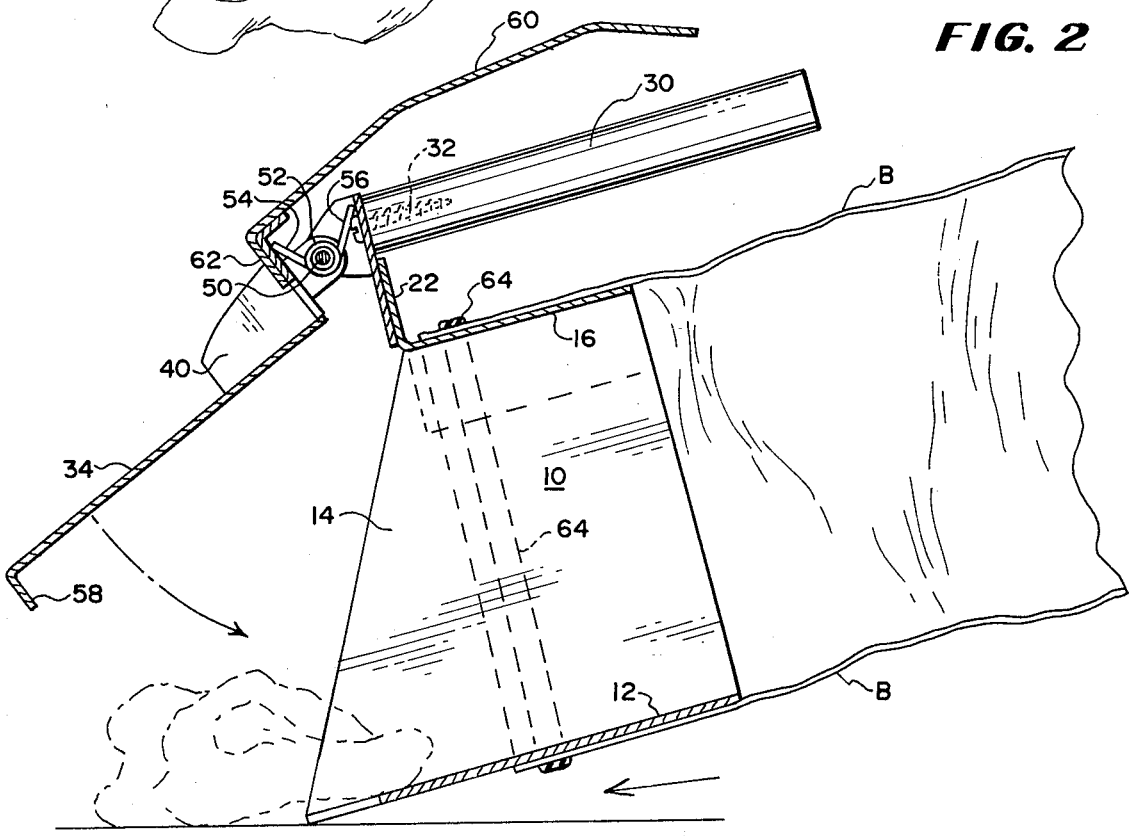
FIG. 2 is a sectional view taken on the vertical plane indicated by the dotted line 2—2 of FIG. 1 and in the direction of the arrows.

Referring now to the drawings in detail and in particular to FIGS. 1 and 2, the refuse collecting device of the present invention is comprised essentially of a relatively short, open-ended, tubular, scoop-like body 10 having a bottom wall 12, spaced apart parallel side walls 14, and a top wall 16. The body is rectangular in cross section so that when the bottom wall thereof is normally resting on a supporting surface, the side walls are vertical. The top wall 16 and the bottom wall 12 are rectangular while the side walls 14 are preferably trapezoidal in that their forward edges 18 are inclined upwardly and rearwardly. The forward edge of the bottom wall 12 is formed with a multiplicity of tapered but blunt teeth 20 thereon. As will be evident when the operation of the present refuse collecting device is set forth in detail hereafter, the bottom wall constitutes, in effect, a scoop proper and the teeth 20 thereon perform a raking function when the device is used on a grassy area such as a lawn.

The top wall 16 of the body 10 of the device is formed with an upstanding front flange 22, to the forward side of which there is riveted or otherwise fixedly secured a hinge plate 24 (see FIGS. 1 and 4) having a central upstanding hinge lug 26 which is provided at its ends with forwardly extending ears 28. As shown in the drawings, the hinge lug 26 projects upwardly above the level of the upper edge of the upstanding flange 22. A wooden or other elongated handle 30 is secured by means of a screw 32 to the hinge lug 26 and extends rearwardly a short distance above the top wall 16. Such handle is adapted to be grasped in one hand of the operator or user when manipulating the device in a manner that will be made clear subsequently.

As best shown in FIG. 4 of the drawings, the open front end of the body 10 is adapted to be closed by means of a generally rectangular combined closure plate and paddle memeber 34, the upper edge region of which has riveted or otherwise secured thereto to hinge bracket 36. The latter is generally of inverted U-shape configuration and embodies a pair of attachment flanges 38 by means of which the bracket 36 as a whole is secured to the combined plate and paddle member 34 and, in addition, a pair of forwardly extending flanges 40 and a horizontal bridge wall 42. The latter projects forwardly of the upper edge of the combined closure plate and paddle member 34 and extends at right angles to the latter. The side flanges 40 also extend at right angles to said member 34, and the attachment flanges 38 are formed integrally with and project outwards from the inner side edge portions of the side flanges 40 and a preferably riveted to the combined closure plate and paddle member 34. Two laterally spaced ears 44 are struck upwardly out of the plane of the bridge wall 42 of the bracket 36 and have formed therein aligned holes 46. The latter register with similarly aligned holes 48 which are formed in the ears 28. An elongated horizontal hinge pin 50 has its end regions supported in the registering holes 46 and 48 and receives thereover a pair of hinge biasing springs 52. Each spring 52 is provided with a leg 54 which bears against the bridge wall 42 of the hinge bracket 36, and a leg 56 which bears against the hinge plate 24.

From the above description, it will be appreciated that the hinge plate 24 and the hinge bracket 36 constitute, in effect, a pair of hinge leaves by means of which the combined closure plate and paddle member 34 is hingedly connected to the forward edge of the top wall 16 of the tubular body 14 and that such member is capable of swinging movement about the axis of the hinge pin 50 between the open position wherein it is shown in FIGS. 1 and 2, and the closed position in which it is shown in FIG. 3. It is to be noted at this point that when the combined closure plate and paddle member 34 is in its closed position, a narrow, inwardly extending, right angle flange 58 on the lower or distal edge portion of said member 34 moves into position over the bottom wall 12 of the body 10 a slight distance rearwardly of the teeth 20 on the forward edge of such bottom wall.

As shown in all of the views of the drawings, a lever or thumb piece 60 for manually manipulating the combined closure plate and paddle member has a laterally turned end 62 which is riveted or otherwise fixedly secured to the underneath side of the bridge wall 42 of the hinge bracket 36 and this thumb piece arches rearwardly but nevertheless extends generally vertically and overlies the forward end region of the handle 30 where it is accessible to the thumb of the user of the device so that it may readily be depressed by the use of the thumb. Upon such depression of the thumb piece, it is obvious that the combined closure plate and paddle member 34 may be swung to its open position against the action of the two springs 52 and that, upon release of the thumb piece 60, said combined closure plate and paddle member 34 will be automatically restored to its closed position.

In the operation of the herein described refuse collecting device and as illustrated schematically in FIG. 2, the operator or user will initially secure the open rim or mouth of a suitable container such as the paper or plastic bag B in telescopic fashion over the open rear rim portion of the tubular body 10, utilizing a rubber band to hold the bag in place. Thereafter, by utilizing the manipulating handle 30 to support the body 10, the bottom wall 12 of the latter may be forwardly over the surface of the ground, floor, or other waste-contaminated surface, so that such wall will function in the manner of a scoop and pick up deposites of excrement, it being understood, of course, that at such time, the operator will maintain the combined closure plate and paddle member 34 in its open position by utilizing his or her thumb for this purpose as previously described by moving the thumb piece 60 to an extreme position wherein the distal end of the latter engages or almost engages the handle 30. If at any given time a batch of extrement or other waste fails to respond to the scooping action of the bottom wall 12 of the body 10, the operator may release or relax his or her thumb pressure on the thumb piece 60 and the combined closure plate and paddle member, upon swinging downwardly and rearwardly as indicated by the curved arrow in FIG. 2, will propel the excrement or other material rearwardly and into the confines of the body 10.

After a given batch of excrement has thus been impelled into the confines of the body 10, it is contemplated that the device will be manipulated into the vertical or upended position in which it is illustrated in FIG. 3 to the end that the excrement which has collected on the bottom wall 12 may slide downwards under the influence of gravity into the bag B. The bag may be removed at any time from the body 10 without the hands coming into contact with the contents thereof.

It is to be noted that when the device is being used in a grassy area, the fact that the teeth 20 at the forward edge of the bottom wall 12 are separated by relatively deep V-shaped voids, a raking or coming action is exerted upon the individual blades of grass, thereby tending to leave such blades cleaner than would otherwise be the case.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claims is the same to be limited.

Having thus described the invention, what we claim as new and desired to secure by letters patent is:

1. A refuse collecting device comprising an open-ended tubular body having a planar, normally horizontal scoop-forming bottom wall, upstanding trapezoidal side walls with upwardly and rearwardly inclined front edges, and a top wall, the rear portion of said body being designed for removable reception of the rim region of a disposable bag whereby, upon upending of the body, material which has entered the body will fall by gravity into the bag, a combined closure plate and paddle member hingedly connected to the forward edge portion of said top wall and capable of swinging movement about a horizontal axis between a closed position wherein it extends substantially vertically and is straddled by said side walls, while its lower edge passes across the bottom wall inwardly of the forward edge of the latter, thus closing the open front end portion of the body, and an open forwardly extending position wherein it exposes the interior of the body for scooping purposes, spring means yieldingly biasing said combined closure plate and paddle member to its closed position, a manually graspable handle secured to said body and overlaping said top wall, and a thumb piece having its proximate end secured to said combined closure plate and paddle member and its distal end region disposed in such overlying relation with respect to the handle that depression thereof by the thumb of the user will effect swinging movement of said combined closure plate and paddle member to its open position, and subsequent releases of said handle will cause said spring means to swing the paddle member to its closed position, thus impelling refuse material rearwardly and into the tubular body.

2. A refuse collecting device as set forth in claim 1 and wherein said handle extends substantially parallel to and immediately overlies said top wall.

3. A refuse collecting device as set forth in claim 2 and wherein the forward edge of the top wall of the body is provided with an upstanding flange to which the extreme forward end of the handle is fixedly secured.

4. A refuse collecting device as set forth in claim 3 and wherein the thumb piece arches upwardly and rearwardly from the upper edge of the combined closure plate and paddle member and has its distal end designed for substantial abutment with said handle in order to establish the extreme open position of said combined closure plate and paddle member.

5. A refuse collecting device as set forth in claim 1 and wherein the forward edge of said bottom wall is provided with a coextensive series of comb-like teeth.

6. A refuse collecting device as set forth in claim 1 and wherein the lower edge of said combined closure plate and paddle member is provided with a rearwardly turned lateral flange which, when said member is in its closed position, closely overlies the bottom wall of the body immediately rearwardly of said series of teeth.

7. A refuse collecing device as set forth in claim 6 and wherein the upper edge region of the combined closure plate and paddle member engages the upstanding flange on the forward edge of said top wall when said member is in its closed position so that such flange determines the fully closed position of the member.

* * * * *